US005676052A

United States Patent [19]

Wegrzyn et al.

[11] Patent Number: 5,676,052

[45] Date of Patent: Oct. 14, 1997

[54] APPARATUS AND METHOD FOR TENSIONING A SILK SCREEN

[76] Inventors: Peter F. Wegrzyn, 12153 Rapids Rd., Akron, N.Y. 14001; Matthew D. Murphy, 406 74th St., Niagara Falls, N.Y. 14216

[21] Appl. No.: 534,490

[22] Filed: Sep. 27, 1995

[51] Int. Cl.[6] ..... B41F 15/02; B41F 15/36

[52] U.S. Cl. ..... 101/127.1; 38/102.21; 81/58.1; 81/119; 160/381

[58] Field of Search ..... 101/127.1, 128, 101/128.1; 38/102.1, 102.21; 248/506; 269/41, 111, 115, 116, 117; 81/58, 58.1, 119, 176.1, 186; 160/374.1, 377, 378, 381

[56] References Cited

U.S. PATENT DOCUMENTS

| | | | |
|---|---|---|---|
| 3,601,912 | 8/1971 | Dubbs | 101/127.1 |
| 5,063,842 | 11/1991 | Clarke | 101/127.1 |
| 5,274,934 | 1/1994 | Newman, Jr. | 101/128.1 |
| 5,488,901 | 2/1996 | Hruska | 101/127.1 |

FOREIGN PATENT DOCUMENTS

| | | | |
|---|---|---|---|
| 551634 | 4/1923 | France | 81/119 |
| 695069 | 8/1953 | United Kingdom | 269/117 |

*Primary Examiner*—Stephen R. Funk
*Attorney, Agent, or Firm*—Bilicki & Simpson, P.C.

[57] ABSTRACT

An apparatus and method for tensioning a screen on a roller frame are disclosed. The apparatus includes a fixture having a plurality of clamp mechanisms for releasably securing the frame to define a screen tensioning plane, and at least one double-headed wrench for applying torque to the frame rollers adjacent opposite ends thereof. Each torque wrench includes a lever arm which is operable by torso engagement, thereby freeing a user's hands for manually unlocking and locking a selected roller for rotation.

19 Claims, 5 Drawing Sheets

APPARATUS AND METHOD FOR TENSIONING A SILK SCREEN

BACKGROUND OF THE INVENTION

A. Field of the Invention

The present invention relates generally to the field of silk screen printing, and more particularly to an apparatus and method for use in tensioning a screen on a roller frame.

B. Description of the Prior Art

The process of silk screen printing, wherein ink is forced through interstices of a tensioned screen material having predetermined interstices blocked to form an image, is well known and widely used particularly in the manufacture of T-shirts and the like.

In order to allow tensioning of a screen and maintain the screen in a stable, tensioned condition to prevent unwanted stretching thereof during the printing process, the screen may be mounted on a roller frame of a type having a plurality of elongated rollers each having two opposite ends, a plurality of corner members, and adjustable coupling means for coupling the ends of the rollers to the corner members, whereby the rollers may be selectively rotated about their respective axes to impart tension to the screen held thereby. Roller frames of this type are disclosed for example in U.S. Pat. No. 3,601,912 to Dubbs and U.S. Pat. Nos. 3,908,293; 4,345,390; and 5,127,176 to Newman, and are typically rectangular in shape.

Heretofore, the task of setting up and tensioning a screen on a conventional roller frame has been difficult and time consuming. Setting up a screen on a frame involves attaching portions of the screen along the lengths of each roller, such as by "zip locking" the screen into longitudinal channels in the respective rollers using screen attachment strips pressed into the channels by a hand wheel. In order to tension a screen according to widely practiced methodology, a selected roller is unlocked for rotation by adjusting the coupling means at each end of the roller, a conventional single-headed torque wrench is placed at a first end of the roller and manually operated through an angular displacement to rotate the roller about its longitudinal axis, and the coupling means at the first end is tightened to lock the roller against rotation. With the first end of the roller locked, the torque wrench is placed at the opposite end of the roller and the coupling means at the opposite end is tightened. This procedure is repeated with respect to the same or other rollers of the frame until a desired tension is achieved, as confirmed by a tension meter intermittently placed at the center of the screen for tension measurement purposes.

Setting up a screen on a frame can be unnecessarily burdensome if the frame is not secure and at a comfortable height, with the longitudinal channels exposed for easy access. Moreover, during tensioning pursuant to the above method, it is common for the frame to become "warped" so that the corner members of the frame are no longer coplanar. To flatten a warped frame, coupling means at an appropriate corner member must be loosened and torque reapplied to the unlocked roller end.

Another drawback of the above prior art tensioning method is that it is very difficult to achieve uniform rotation of a roller over its entire length because torque is applied only at one end of a roller at a time. This results in torsional stress in the rollers and non-uniform tension in the screen.

The above mentioned problems become more difficult to contend with as higher screen tensions are sought. Screen tensions of between 20 and 30 N/cm have commonly been achieved under prior art methodology, however higher screen tensions of 40 N/cm and more are now recognized as desirable for improving print quality and efficiency.

In view of the disadvantages inherent in the prior art, a skilled and experienced worker is typically able to set up and tension only approximately seventeen screens during an eight-hour workday, usually with somewhat inconsistent quality results.

SUMMARY OF THE INVENTION

Therefore, it is an object of the present invention to provide an apparatus and method for setting up and tensioning a silk screen on a roller frame in a simpler and more efficient manner.

It is another object of the present invention to provide an apparatus and method for tensioning a silk screen on a roller frame which repeatably results in more uniformly tensioned screens of high quality.

It is a further object of the present invention to provide an apparatus and method for tensioning a silk screen on a roller frame which enables higher screen tensions to be achieved easily.

It is yet a further object of the present invention to eliminate warping and tension inequalities in the roller frame and screen.

In advancement of these and other objects, an apparatus for tensioning a silk screen on a conventional roller frame generally comprises a fixture having clamping means for releasably securing said frame at its corner members such that the frame defines a tensioning plane for the screen, and at least one double-headed torque wrench detachably mountable on the fixture for rotating a selected one of the rollers about its longitudinal axis while permitting adjustment of coupling means at the ends of the selected roller.

In a preferred embodiment, the fixture includes a support structure and a plurality of toggle clamp mechanisms associated one to a corner member of the frame. The clamp mechanisms are mounted on the support structure in a plane parallel to the screen tensioning plane and provide clamping force along a clamping axis perpendicular to the tensioning plane. A base portion of each clamp mechanism is connected to the support structure by an adjustable fastener for enabling pivotal motion of the clamp mechanism about its clamping axis when the fastener is in a loosened condition. The support structure preferably includes a plurality of clamp platforms for supporting the clamp mechanisms, with each clamp platform having a plurality of spaced mounting holes for mounting a clamp mechanism at a chosen location on the platform. Each clamp platform is attached to the support structure by an adjustable fastener for selectively enabling pivotal motion of the clamp platform to adjust for differently sized frames. The support structure is also preferably provided with adjustable feet for adjusting the level of the screen tensioning plane.

A torque wrench for use in conjunction with the fixture to rotate a roller about its longitudinal axis preferably comprises a pair of heads spaced apart and adapted to simultaneously engage the roller adjacent its ends. Where the rollers of a particular roller frame are not of uniform length, such as in the case of a rectangular frame, a plurality of wrenches having differently spaced heads corresponding to the various roller lengths may be provided, however it is also contemplated to provide a single wrench having means for adjusting the spacing between the heads. A bridge member connects the pair of heads and an elongated lever arm extends from an intermediate portion of the bridge member. The lever arm is preferably arcuately shaped and padded for comfortable torso operation by a user during tensioning of a screen according to a preferred method of the present invention.

The fixture may be used to secure a roller frame at a comfortable height for set up purposes, i.e. attaching a screen to the frame, prior to tensioning. Subsequently, in accordance with a preferred method of the present invention, the roller frame is mounted on the fixture and secured at its corner members such that the frame defines a tensioning plane for the screen attached thereto. The coupling means are then adjusted such that one of the rollers is unlocked for rotation about its longitudinal axis while the remaining rollers are in a locked condition. Torque is then applied evenly to the unlocked roller adjacent its ends using the double-headed wrench to rotate the roller about its longitudinal axis, whereby tensioning force is imparted to the screen in the tensioning plane. A user may operate the torque wrench by leaning forward with his or her torso applying force to the lever arm, thereby leaving the user's hands free to adjust coupling means at opposite ends of the roller. Following the application of torque, the coupling means associated with the ends of the roller may be locked such that the tension is retained. These steps may be repeated with respect to the various rollers as necessary in order to achieve a desired screen tension. Once a desired tension is achieved, the toggle clamps may be released for removal of the frame from the fixture.

BRIEF DESCRIPTION OF THE DRAWINGS

The nature and mode of operation of the present invention will now be more fully described in the following detailed description taken with the accompanying drawings wherein.

DETAILED DESCRIPTION

Figure 1:
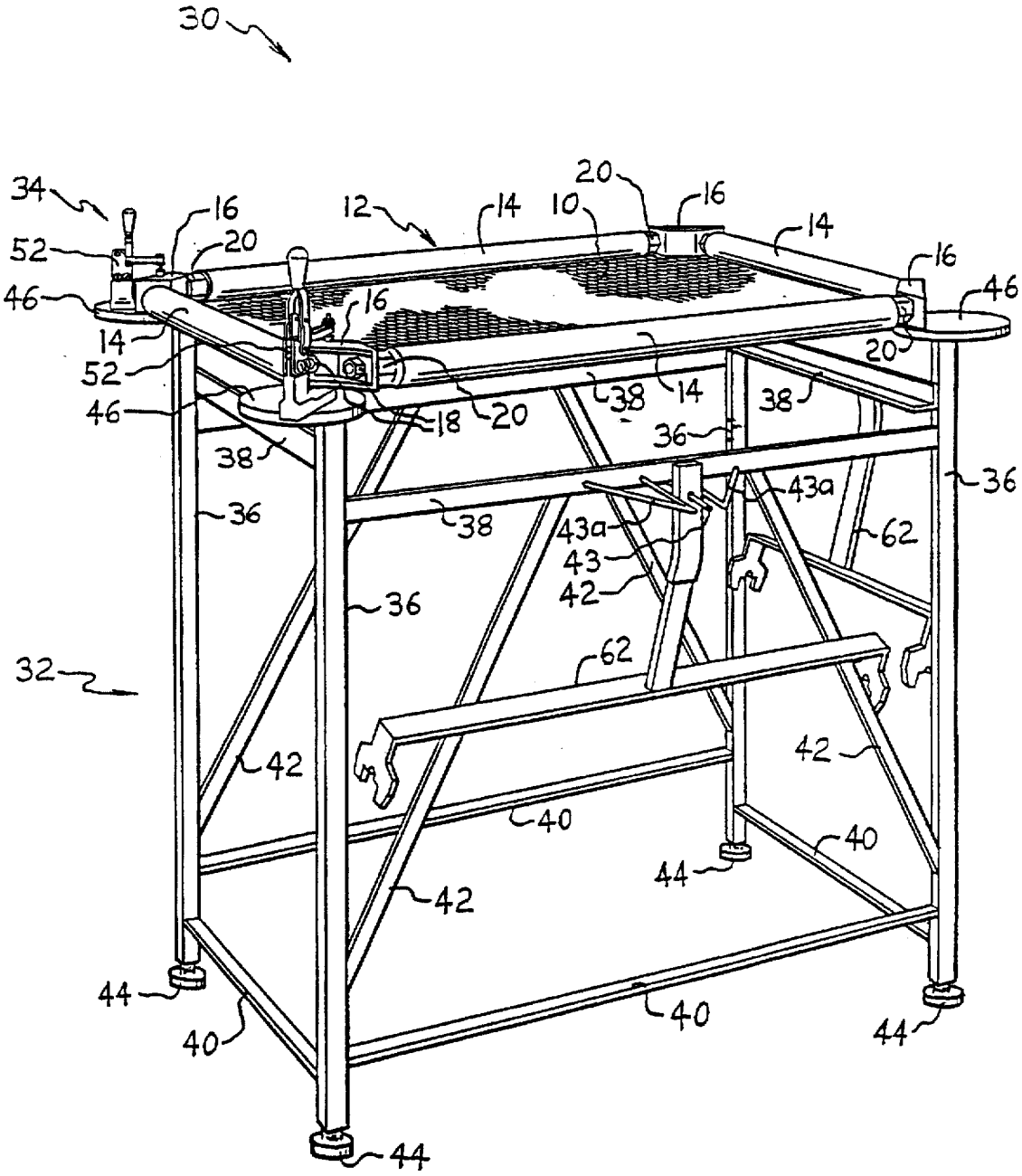
FIG. 1 is a perspective view of a fixture formed in accordance with a preferred embodiment of the present invention and having a roller frame and associated screen secured thereby.
Figure 2:
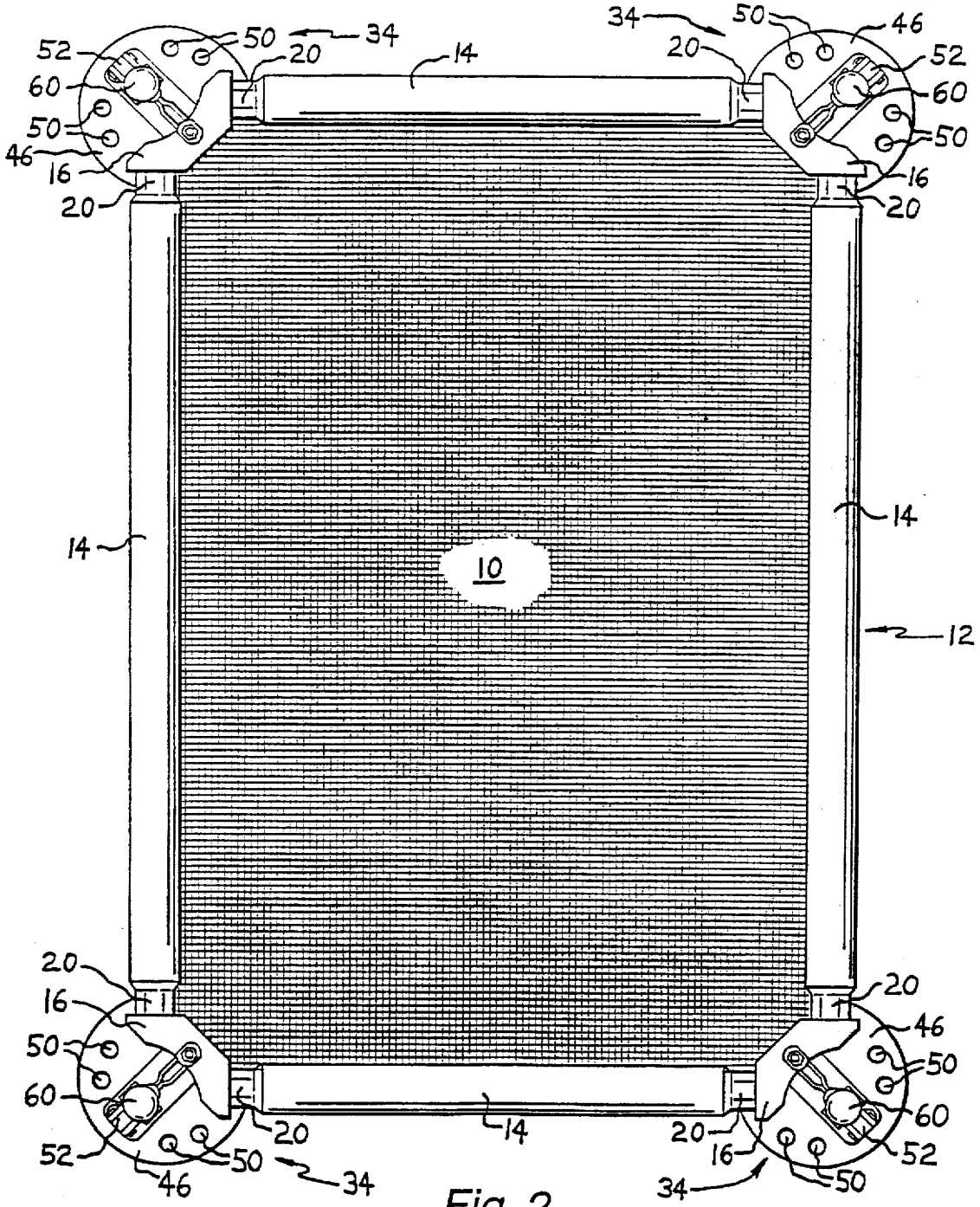
FIG. 2 is a top plan view of thereof.

Reference is made first to FIGS. 1 and 2, wherein a screen 10 to be tensioned is held on a conventional rectangular roller frame 12, such as may be available from Stretch Devices, Inc. and/or which may be formed in accordance with one of the U.S. patents mentioned previously herein at paragraph two of the Description of the Prior Art. Frame 12 is generally of a type comprising a plurality of elongated cylindrical rollers 14 each having opposite ends coupled to right angle corner members 16 by adjustable coupling means 18. Coupling means 18 are normally in a locked condition to prevent rotation of rollers 14 about their longitudinal axes, however coupling means 18 associated with opposite ends of a selected roller may be adjusted to an unlocked condition to permit rotation of the selected roller about its longitudinal axis. Portions 20 adjacent the ends of each roller 14 are adapted for engagement by torque means, such as by providing portions 20 with a hexagonal cross-section for wrench engagement. As may be appreciated, rotation of a roller 14 about its longitudinal axis will either relieve tension in screen 10 or, more desirably, increase tension in screen 10. Screen 10 and frame 12 form no portion of the present invention.

In accordance with a preferred embodiment of the present invention, a fixture generally indicated as 30 is designed for use with rectangular roller frames and generally includes a support structure 32 and clamping means 34 for releasably securing frame 12 at corner members 16 such that corner members 16 are coplanar, whereby frame 12 defines a tensioning plane for screen 10 extending tangentially from rollers 14.

Support structure 32 is preferably of a sturdy welded-steel construction and includes a plurality of elongated vertical leg members 36 connected by upper transverse members 38 and lower transverse members 40, with inclined truss members 42 extending between leg members 36 and upper transverse members 38. Upper transverse members 38 are preferably formed of angle steel to provide shelves for screen attachment strips (not shown) used to attach screen 10 to rollers 14. A pair of hanger members 43, one of which is visible in FIG. 1, extend from adjacent upper transverse members 38, and are surrounded on opposite sides by guard members 43a. Threadably adjustable feet 44 are provided at a bottom end of each respective leg member 36 for leveling fixture 30, and more particularly for leveling the screen tensioning plane.

The support structure further includes a plurality of clamp platforms 46 each attached to a top end of a respective leg member 36 by a threaded fastener 48 (visible in FIG. 3) received within an axially extending tapped hole in the leg member. Clamp platforms 46 are preferably circular discs each having an eccentrically drilled hole therein through which fastener 48 extends, thus enabling clamp platforms 46 to be selectively pivoted about an eccentric axis to accommodate differently sized frames. Clamp platforms 46 further include a plurality of variously located clamp mounting holes 50.

Figure 3:
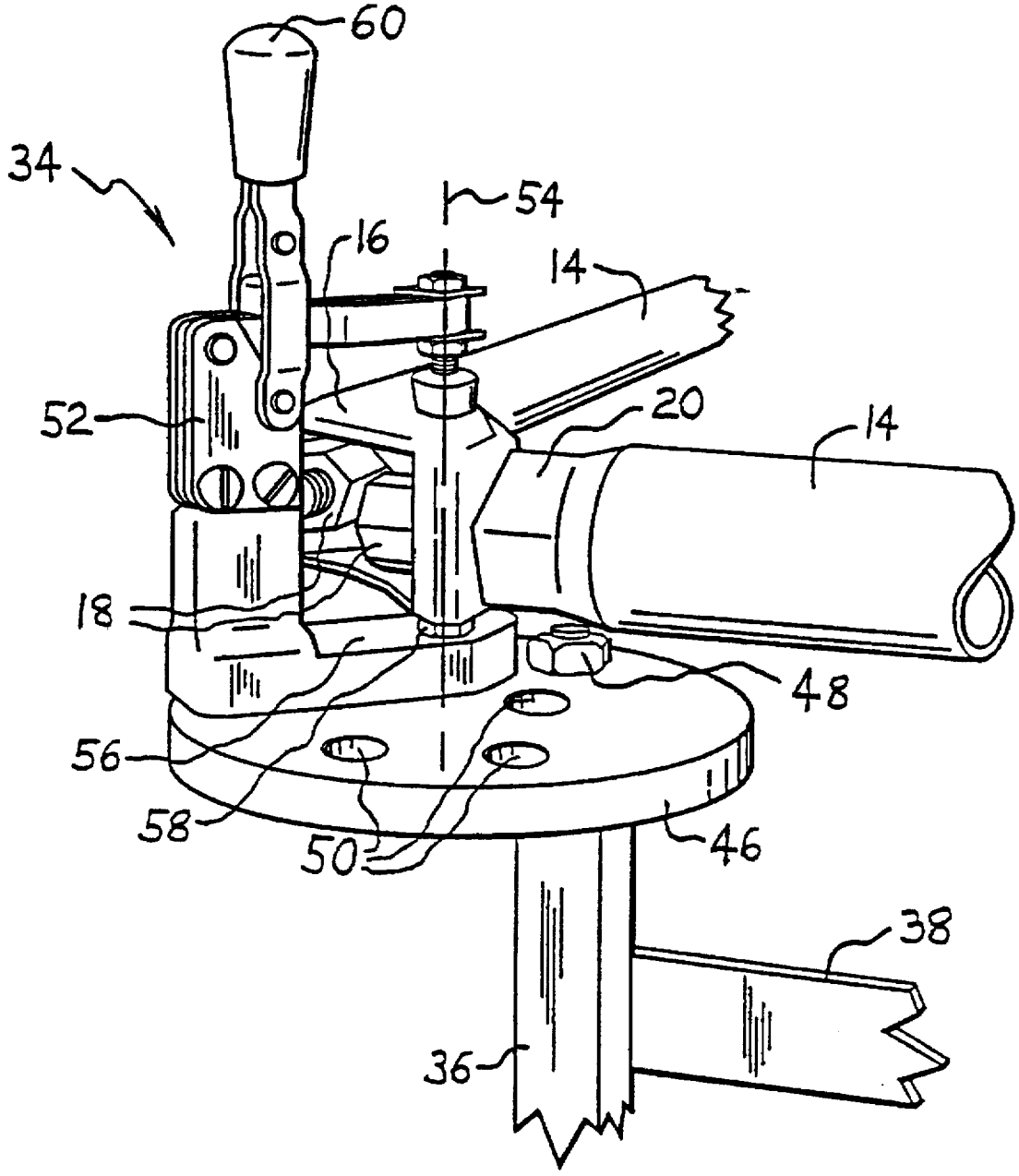
FIG. 3 is an enlarged perspective view showing clamping means of the present invention.

Clamping means 34 according to the present invention comprises a plurality of clamp mechanisms 52 mounted on respective clamp platforms 46 in a plane parallel to the screen tensioning plane for association one to a corner member 16. As best shown in FIG. 3, clamp mechanisms 52 are generally C-shaped and provide a clamping force along a clamping axis 54 perpendicular to the screen tensioning plane. A base portion 56 of each clamping mechanism 52 is mounted on respective clamp platform 46 by a threaded fastener 58 preferably aligned with clamping axis 54 and extending through a selected clamp mounting hole 50. Consequently, the orientation of clamp mechanism 52 may be controlled by pivoting the clamp mechanism about clamping axis 54 when fastener 58 is in a loosened condition to allow operative access to coupling means 18 associated with corner member 16. Clamping mechanisms 52 are preferably toggle type clamps operable between a released position and a secured position by toggle 60.

Figure 4:
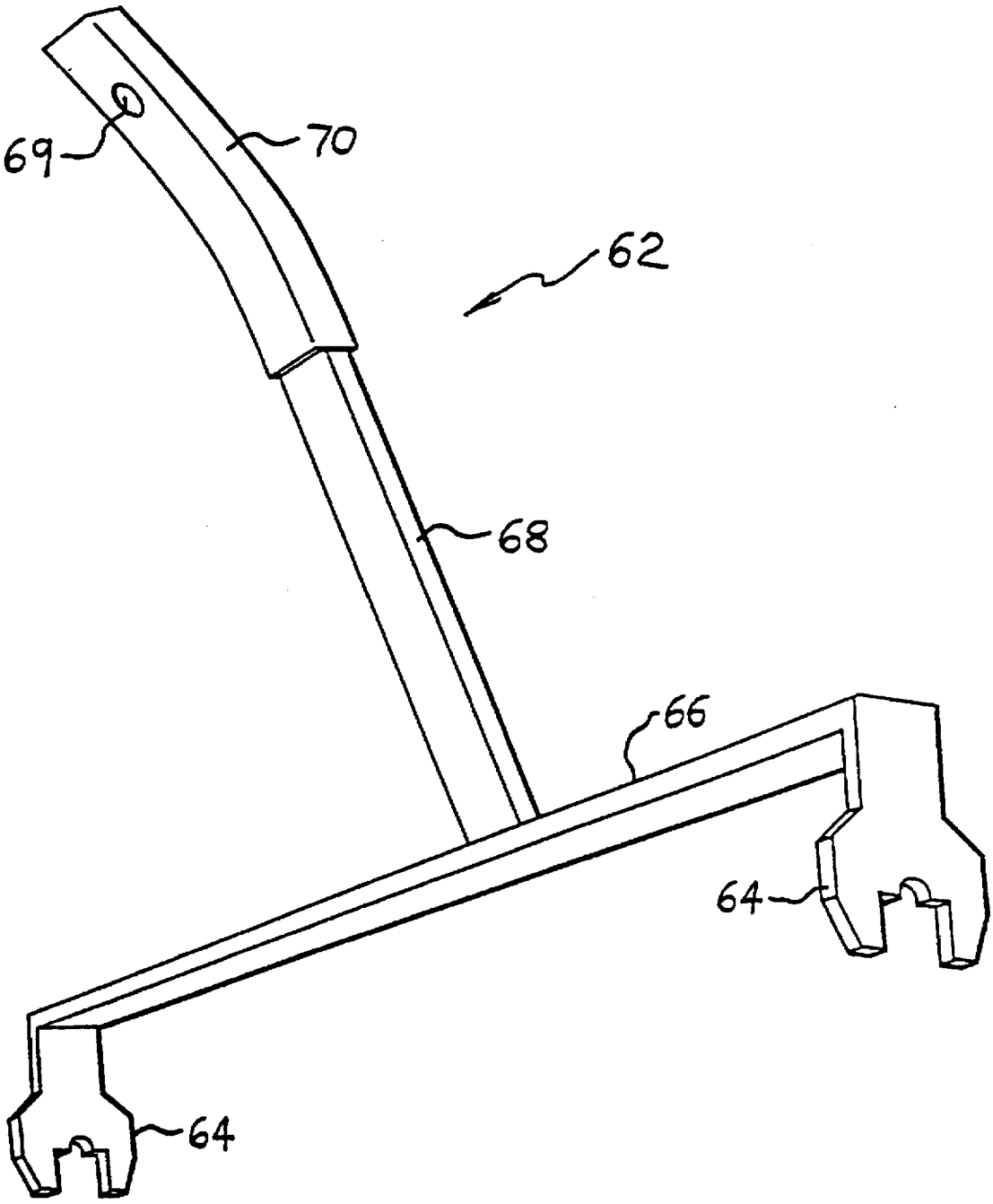
FIG. 4 is a perspective view of a preferred embodiment torque wrench according to the present invention.

Referring presently to FIG. 4, at least one double-headed torque wrench 62 is provided for applying torque to rollers 14 about their longitudinal axes and is detachably mountable on fixture 30 by hanger member 43. Wrench 62 includes a pair of heads 64 spaced apart to engage a roller 14 at portions 20 adjacent its opposite ends. A bridge member 66 connects heads 64, and an elongated lever arm 68 extends from an intermediate portion of bridge member 66 and includes an opening 69 at a distal end thereof for 20 receiving hanger member 43. Lever arm 68 is preferably adapted for torso operation, as will be described hereinafter, such as by forming the lever arm in the shape of an arc, affixing padding 70 thereto, and/or increasing the surface area of lever arm 68 engaged by the torso.

The number of different wrenches 62 required for use in tensioning a screen may correspond to the number of different lengths of rollers 14 in frame 12, with the heads 64 of each wrench 62 having a unique spacing to fit a particular roller length. Hence, where frame 12 is rectangular, two separate wrenches 62 may be required. However, it is also contemplated to provide only one wrench 62 having means for adjusting the spacing between heads 64.

Figure 5:
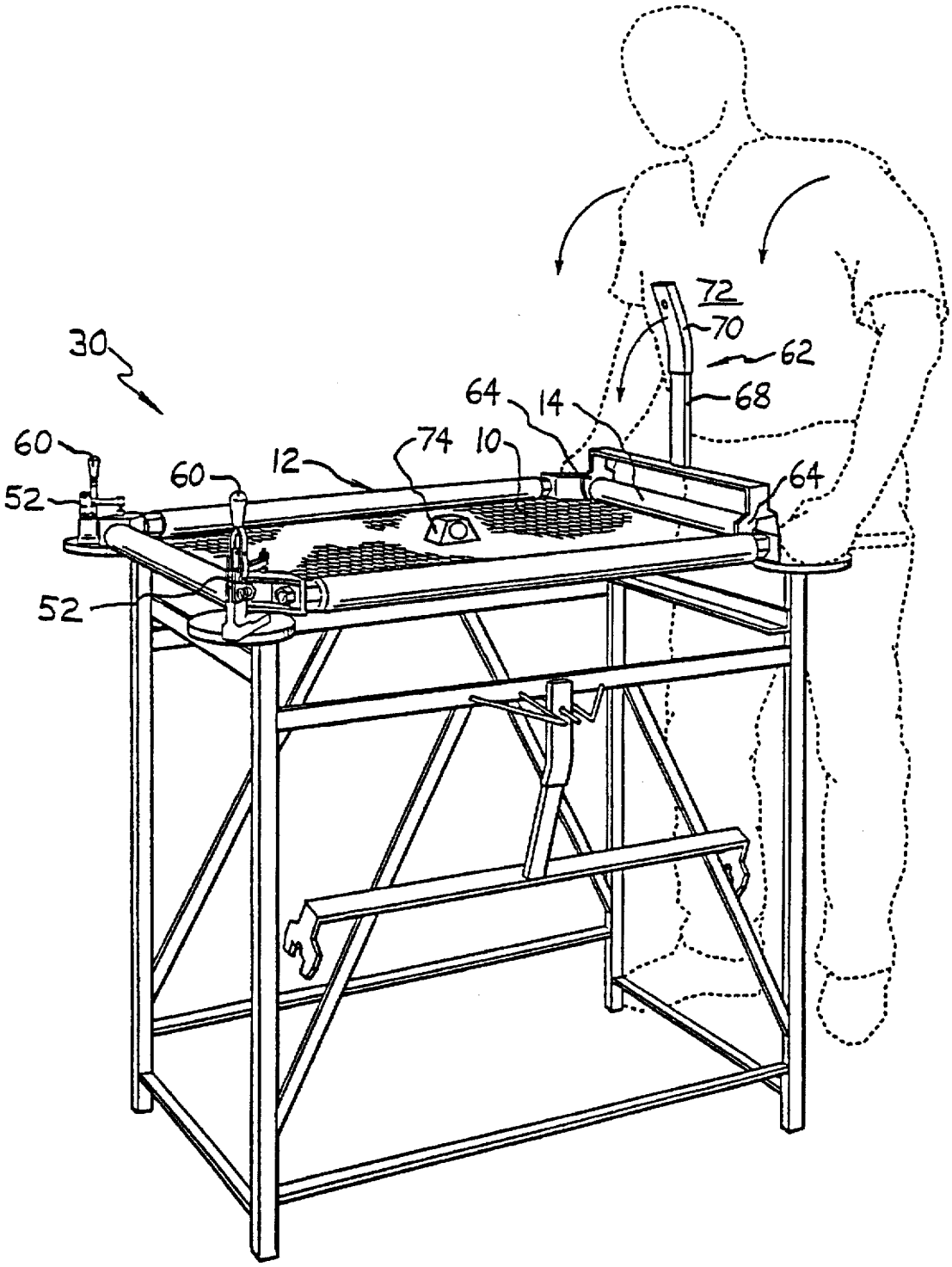
FIG. 5 is a view illustrating operation of the apparatus of the present invention to tension a screen.

A preferred method of tensioning screen 10 using the above-disclosed apparatus will now be described with reference primarily being made to FIG. 5. It should be noted that prior to tensioning, set up is required to attach screen 10 to rollers 14. During set up, clamp mechanisms 52 are used to secure corner members 16 to fixture 30. With frame 12 secure, coupling means 18 may be unlocked as necessary to permit rollers 14 to be rotated about their longitudinal axes to expose longitudinal channels (not shown) and then locked to prevent rotation of rollers 14. Screen 10 may then be attached to rollers 14 such as by zip locking as mentioned above. Once set up is complete, frame 12 may be released from fixture 30 and turned over such that screen 10 is generally on an underside of frame 12 as shown in FIG. 5.

With screen 10 attached to frame 12 and toggles 60 in their released positions, the frame is positioned on fixture 30 with corner members 16 intersecting respective clamping axes 54. Frame 12 is then clamped in place on fixture 30 by operation of toggles 60 to their secured positions. Where necessary to enable operative access to coupling means 18, each clamp mechanism 52 may be pivoted about an axis defined by associated fastener 58 to a beneficial position when fastener 58 is in a loosened condition. With frame 12 secured on fixture 30 as shown, it will be understood that a screen tensioning plane extends tangentially from rollers 14 on an underside of frame 12.

One of rollers 14 is then selected to be rotated about its longitudinal axis using a torque wrench 62 having suitably spaced heads 64 engaging the roller at portions 20 adjacent its opposite ends. With lever arm 68 angled outward from frame 12 against the torso of a user 72, the user manually unlocks coupling means 18 at the ends of the selected roller, leans forward to operate lever arm 68 with the torso and thereby rotate the roller about its longitudinal axis, and then manually locks coupling means 18 to fix the roller against rotation. The foregoing procedure may be repeated with respect to the same or a different roller 14 as required to achieve a desired tension in screen 10 as indicated by a tension meter 74 continuously situated at the center of screen 10 in view of user 72. Because frame 12 is securely held by fixture 30 and screen 10 is supported only by frame 12, tension may be monitored continuously during the tensioning process, rather than at discrete times as in prior art methods, for improved quality control. Once a desired tension is achieved, toggles 60 may be moved to their released positions to unclamp frame 12. The tensioned screen and roller frame remain unwarped after being unclamped from fixture 30.

Of course, it will be appreciated that two persons may operate the apparatus of the present invention to tension a screen, with a first person unlocking and locking coupling means 18 and a second person manually operating torque wrench or wrenches 62. Those skilled in the art will recognize that the present invention obviates the need for highly skilled and experienced workers to tension screens, and results in greatly improved efficiency. The prior art productivity of seventeen screens per day has been dramatically increased to seventeen screens per hour by the present invention as claimed below.

What is claimed is:

1. A fixture for stabilizing a roller frame during tensioning of a screen on said frame, said frame having a plurality of elongated rollers each having two ends, a plurality of corner members, and coupling means for coupling the ends of said rollers to said corner members, said coupling means being adjustable to an unlocked condition for permitting rotation of said rollers about their longitudinal axes and a locked condition for preventing rotation of said rollers about their longitudinal axes, said fixture comprising:

a support structure; and clamping means having a base portion mounted on said support structure by adjustable fastening means for releasably securing said frame at said corner members such that said frame defines a tensioning plane for said screen, said clamping means being selectively positionable by said adjustable fastening means to permit user access to said coupling means.

2. The fixture according to claim 1, wherein said support structure includes a plurality of adjustable feet for adjusting the level of said tensioning plane.

3. The fixture according to claim 1, wherein said clamping means comprises a plurality of clamp mechanisms associated one to a corner member, said clamp mechanisms being mounted on said support structure in a plane parallel to said tensioning plane and providing force along a clamping axis perpendicular to said tensioning plane.

4. The fixture according to claim 3, wherein each said clamp mechanism is generally C-shaped.

5. The fixture according to claim 3, wherein said clamp mechanism is a toggle clamp operable between a released position and a secured position.

6. The fixture according to claim 3, wherein said support structure includes a plurality of clamp platforms for supporting said plurality of clamp mechanisms.

7. The fixture according to claim 6, wherein each of said plurality of clamp platforms is attached to said support structure by adjustable fastening means for enabling pivotal motion of said clamp platform about an axis perpendicular to said tensioning plane when said fastening means is in a loosened condition.

8. The fixture according to claim 6, wherein each of said plurality of clamp platforms includes a plurality of spaced mounting holes for mounting said clamp mechanism supported thereby in different locations.

9. An apparatus for use in tensioning a screen mounted on a roller frame, said frame having a plurality of elongated rollers each having two ends, a plurality of corner members, and coupling means for coupling the ends of said rollers to said corner members, said coupling means being adjustable to an unlocked condition for permitting rotation of said rollers about their longitudinal axes and a locked condition for preventing rotation of said rollers about their longitudinal axes, said apparatus comprising:

a fixture having clamping means for releasably securing said frame at said corner members such that said frame defines a tensioning plane for said screen; and a single torque means simultaneously applied to said two ends of a selected one of said rollers for rotating said one of said rollers about its longitudinal axis.

10. The apparatus according to claim 9, wherein said torque means includes a lever arm adapted for operation by pushing with a torso to rotate said one roller without use of the hands of the user, whereby the hands may be used for adjustment of said coupling means.

11. The apparatus according to claim 9, wherein said torque means is at least one wrench comprising a pair of heads spaced apart and adapted to simultaneously engage said one roller adjacent respective ends thereof, a bridge member connecting said pair of heads, and an elongated lever arm extending from an intermediate portion of said bridge member.

12. The apparatus according to claim 11, wherein said at least one wrench comprises a plurality of wrenches having said pair of heads spaced apart by different distances corresponding to different lengths of said plurality of rollers.

13. The apparatus according to claim 11, wherein said fixture includes at least one hanger member for supporting said at least one wrench while said at least one wrench is not in use.

14. A method of tensioning a screen on a roller frame, said frame having a plurality of elongated rollers each having two ends, a plurality of corner members, and coupling means for coupling the ends of said rollers to said corner members, said coupling means being adjustable to an unlocked condition for permitting rotation of said rollers about their longitudinal axes to change the tension of said screen and a locked condition for preventing rotation of said rollers about their longitudinal axes, said method comprising the steps of:

a) mounting said frame on a fixture and securing said frame at said corner members such that said frame defines a tensioning plane for said screen;

b) adjusting said coupling means such that said coupling means associated with the ends of a selected one of said rollers are unlocked and said coupling means associated with the ends of each remaining roller are locked;

c) simultaneously applying torque to said two ends of said one roller; and d) locking said coupling means associated with the ends of said one roller.

15. The method according to claim 14, wherein steps (b) through (d) are repeated as necessary to achieve a desired tension in said screen, the selection of said one roller for each repetition being independent of a preceding roller selection.

16. The method according to claim 14, wherein torque is applied to said one roller simultaneously at opposite ends thereof using a wrench having a pair of heads spaced apart to engage said ends.

17. The method according to claim 16, wherein a lever arm of said wrench is operated without hands of a user.

18. The method according to claim 17, wherein said lever arm is operated by pressing on said lever arm with a torso.

19. The method according to claim 14, wherein a tension meter is situated on said screen while said frame is secured on said fixture to continuously monitor tension in said screen.

* * * * *